United States Patent [19]

Finney

[11] Patent Number: 4,929,197

[45] Date of Patent: May 29, 1990

[54] HIGH DENSITY CONNECTOR

[75] Inventor: Robert E. Finney, Los Angeles, Calif.

[73] Assignee: ITT Corporation, New York, N.Y.

[21] Appl. No.: 357,832

[22] Filed: May 30, 1989

[51] Int. Cl.[5] ..... H01R 13/00

[52] U.S. Cl. ..... 439/660; 439/861

[58] Field of Search ..... 439/389–426, 439/660, 736, 861, 862

[56] References Cited

U.S. PATENT DOCUMENTS 3,227,991 1/1966 Zdanis ..... 439/397

4,527,857 7/1985 Hughes et al. ..... 439/397

*Primary Examiner*—Joseph H. McGlynn

*Attorney, Agent, or Firm*—Thomas L. Peterson

[57] ABSTRACT

A connector is provided which enables close spacing of socket contacts in a highly reliable manner. The connector includes contact assemblies that each have at least two sheet metal contacts (26, 28 in FIG. 2) lying in parallel planes and a dielectric support (54) molded to the rearward portions of the contacts and to wire conductors (50, 52) connected thereto. The dielectic support includes a spacer portion (56) with a pair of arms (60, 62) separating the forward or mating ends of the socket contacts. The spacer arms are initially molded so they diverge from living hinges (66, 68) connecting them to the rearward portion of the support, the arms being pivotal together and having latches that hold them together at positions between the contacts. One of the arms includes a projection or retainer (106) that holds the contact assembly in a connector frame.

15 Claims, 5 Drawing Sheets

FIG. 11
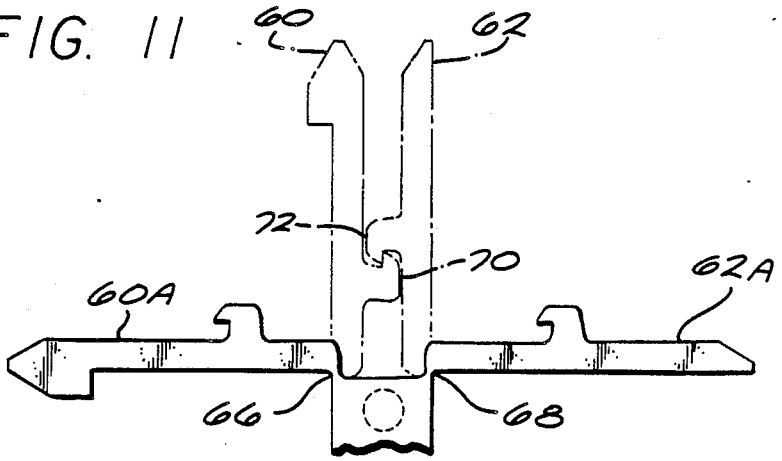
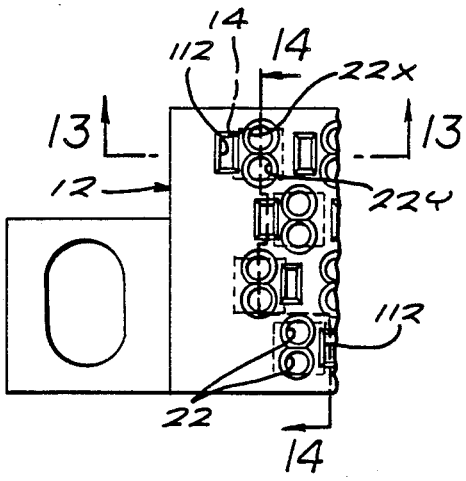
FIG. 12
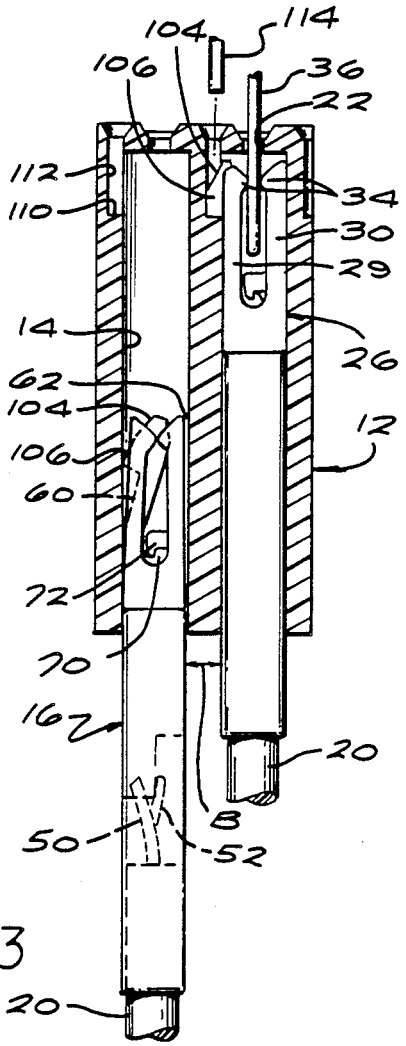
FIG. 13

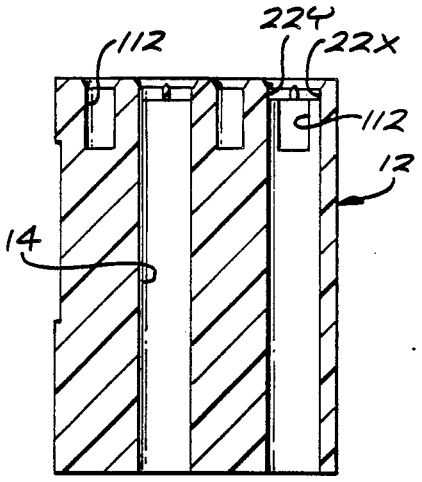
FIG. 14
FIG. 15
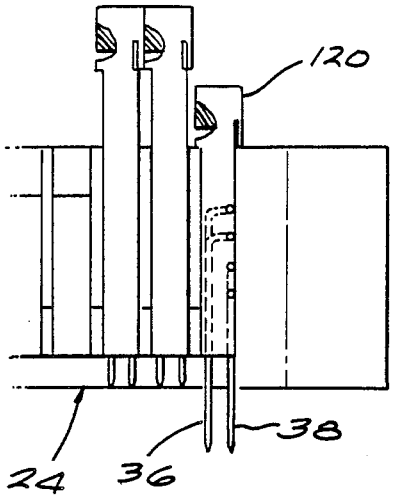
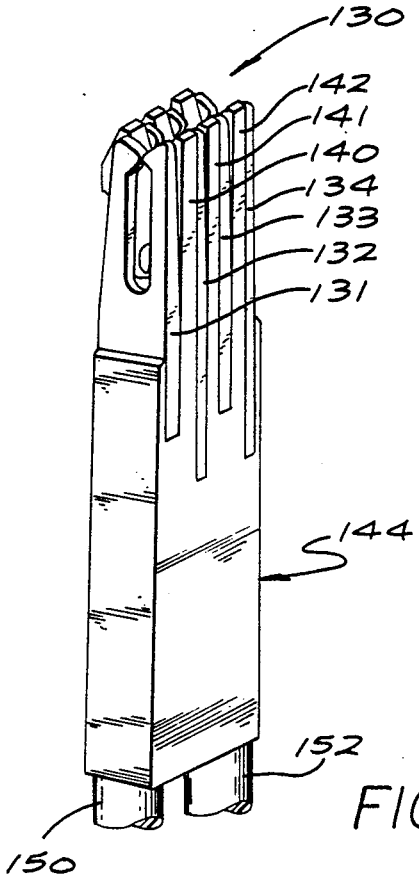
FIG. 16
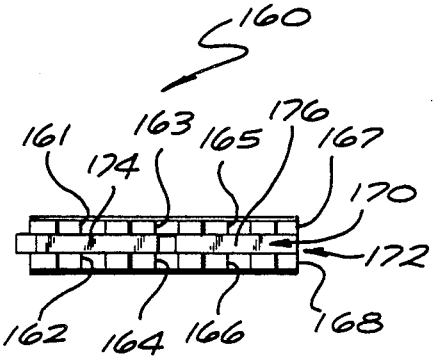
FIG. 17

HIGH DENSITY CONNECTOR

BACKGROUND OF THE INVENTION

Connectors with large numbers of contacts that can be mated and unmated from contacts of corresponding connectors, are useful in a variety of applications, such as to make a large number of connections in large computers. For example, in one application numerous twisted wire pairs lead to the rear of connector frames and connect to pairs of socket contacts in the connector. Very high densities of contacts are required, such as about 400 contacts per square inch in one application. The closely spaced pairs of contacts must provide a known uniform degree of cross talk between contacts with high reliability, and the contact pairs must be easily replaceable in the event that a contact malfunctions. A contact assembly which could meet these requirements would be of considerable value.

SUMMARY OF THE INVENTION

In accordance with one embodiment of the present invention, a connector is provided with contact assemblies that can be constructed of small size at moderate cost, which are reliable, and which are easily replaced. Each contact assembly includes a pair of sheet metal contacts lying in parallel planes and a dielectric support which holds the contacts at a predetermined spacing. The dielectric support includes a spacer portion of about the same thickness as the space between the forward mating portions of the contacts and which lies therebetween, the support also having a rearward portion molded tightly to the rearward portions of the contacts.

In one connector assembly, the spacer portion includes a pair of arms initially molded so they diverge. The rear ends of the arms are connected by living hinges to the rearward portion of the dielectric support. After molding, the arms are pivoted together to lie between the sheet metal contacts, the arms having latches that hold them together when they are brought together. A first of the arms can have a sideward projection near its forward end. The projection snaps into a recess of the connector frame when the connector assembly is installed in the frame, to contain the contact assembly. The recess opens to the front of the frame, so the recess is short and a defective contact assembly can be removed by a tool inserted into the front of the frame while the contact assembly is pulled out of the rear of the frame.

The novel features of the invention are set forth with particularity in the appended claims. The invention will be best understood from the following description when read in conjunction with the accompanying drawings.

BRIEF DESCRIPTION OF THE DRAWINGS

FIG. 11 is a view of a portion of FIG. 8.

FIG. 12 is a plan view of a portion of the socket connector frame of FIG. 1.

FIG. 13 is a view taken on the line 13—13 of FIG. 12, showing the contact assembly of FIG. 3 during insertion, and also after insertion with plug contacts mated to the socket contacts.

FIG. 14 is a view taken on the line 14—14 of FIG. 12.

FIG. 15 is a partial side elevation view of the plug connector frame of FIG. 1, with part of the frame removed, and showing one set of plug contacts in an extended position and others in a retracted position.

FIG. 16 is a perspective view of a connector assembly constructed in accordance with another embodiment of the invention.

FIG. 17 is a plan view of a connector assembly constructed in accordance with still another embodiment of the invention.

DESCRIPTION OF THE PREFERRED EMBODIMENTS

Figure 1:
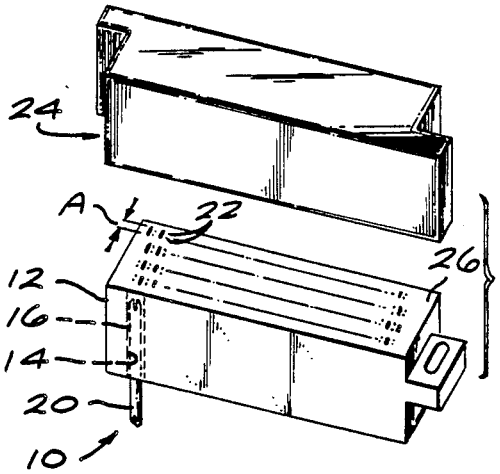
FIG. 1 is a perspective view of a socket connector constructed in accordance with one embodiment of the present invention, shown with a mating plug connector.

FIG. 1 illustrates a socket connector 10 which includes a frame 12 with numerous passages 14 that receive contact assemblies 16. Twisted-pair cables or wires 20 connect to the contact assembly and extend rearwardly therefrom. The frame has numerous holes 22 that each can receive a plug contact to mate with the contact assemblies 16. A plug connector 24 can be positioned opposite the front face 26 of the socket connector 10, and can be operated so its numerous plug contacts project into the holes 22. In one connector that applicant has constructed, the holes 22 are paired at a designated distance apart A of 30 mil (one mil equals one thousandth inch) or about 0.8 mm apart, so the contact assemblies must be made very small.

Figure 2:
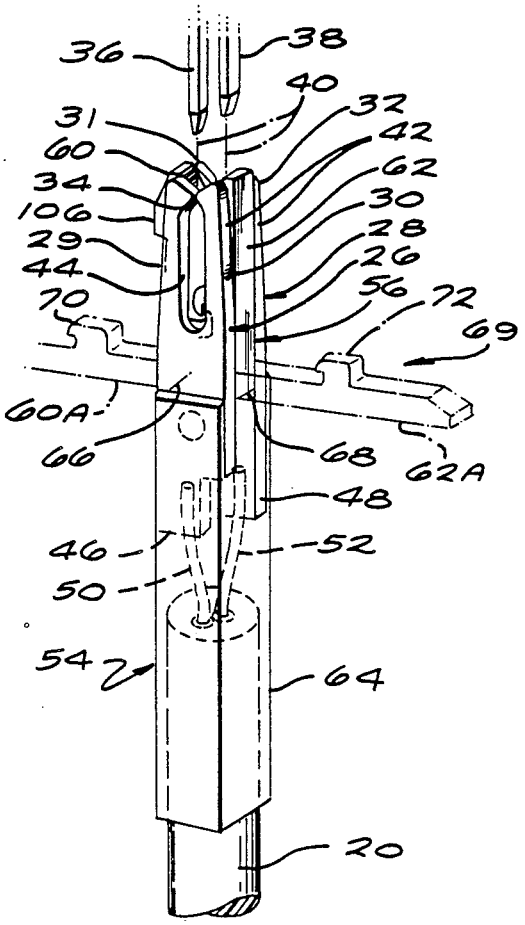
FIG. 2 is a perspective view of a contact assembly of the socket connector of FIG. 1.
Figure 4:
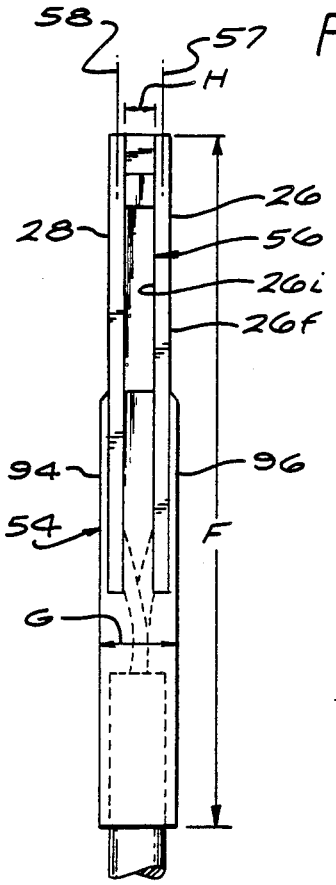
FIG. 4 is a side elevation view of the contact assembly of FIG. 3.

FIG. 2 illustrates the contact assembly 16 which includes two socket contacts 26, 28. Each contact 26, 28 includes two spreadable contact arms 29, 30 and 31, 32. Each pair of arms has bite locations 34 that can spread apart so the assembly can receive plug contacts 36, 38 moving along mating paths 40. The forward mating portion 42 of each dual-arm socket contact such as 26 includes a slot 44 that forms the two arms. Each contact also has a rearward end portion 46, 48 which is permanently connected to a conductor 50, 52 of the twisted pair cable or wire 20, as by welding the end of each conductor to a corresponding socket contact. The two contacts 26, 28 are stamped sheet metal parts held in spaced parallel planes (57, 58 in FIG. 4) by a dielectric support 54.

The dielectric, or insulative, support 54 (FIG. 2) includes a spacer portion 56 which lies between the forward mating portions 42 of the contacts. Specifically, the spacer portion lies between corresponding arms 29, 31 and between arms 30, 32 of the two contacts, which lie on opposite sides of the mating paths 40. The spacer portion is formed by two spacer arms 60, 62. The dielectric support also includes a rearward portion 64 which is molded around the wire conductors 50, 52 and around parts of the rearward portions 46, 48 of the contacts. The dielectric support also includes hinge portions or living hinges 66, 68 which join the rearward support portion to the spacer arms. The spacer arms initially lie at the positions 60A, 62A. As will be described below, after the arms are molded, they are pivoted together. The arms include a latch device 69 formed by barbs or latches 70, 72 that hold the arms together when they are pivoted together.

Figure 6:
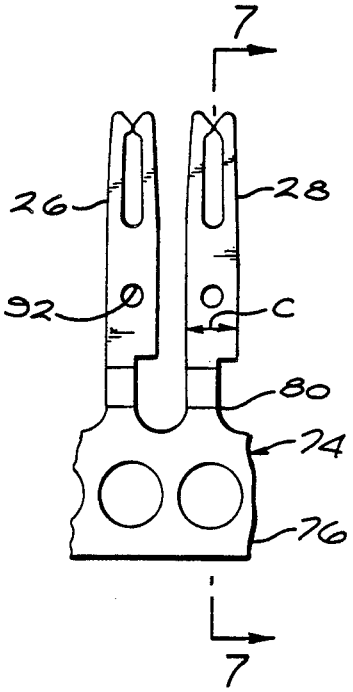
FIG. 6 is an elevation view of a portion of a string of contacts of the type used in the contact assembly of FIG. 2.
Figure 8:
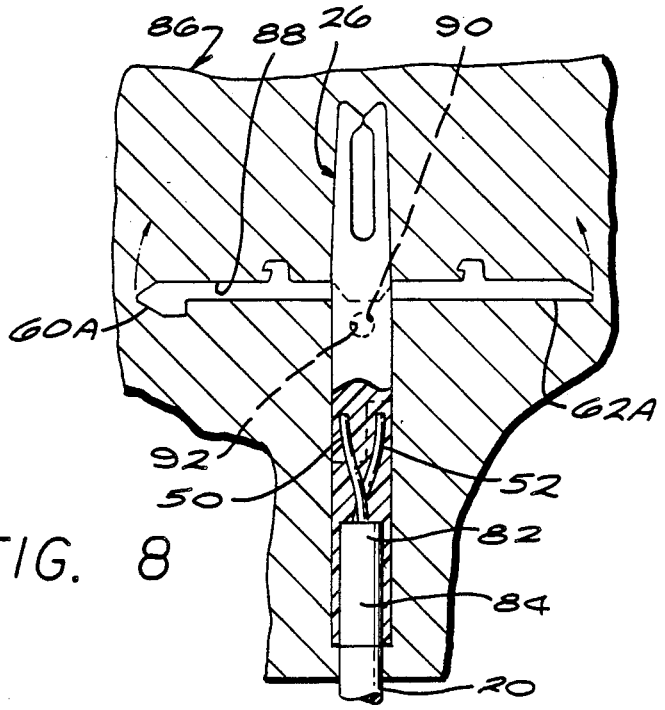
FIG. 8 is an elevation view of the contact assembly of FIG. 3, shown as it is originally molded.

To form the contact assembly, a string of contacts shown at 74 in FIG. 6 is used, which includes a carrier 76 with multiple contacts thereon. Two contacts 26, 28 are broken off at parting lines 80 and attached to conductors 50, 52 as shown in FIG. 8. The insulation 82 around part of the end portion 84 of the wire 20 will have been removed. The wire with the two contacts 26, 28 are placed in a mold 86 shown in FIG. 8, with a cavity 88. A plastic such as nylon is injected into the mold through a sprue hole 90 that is aligned with holes 92 in the contacts. The plastic forms the spacer arms 60A, 62B in an orientation wherein they spread apart. When the assembly is removed from the mold, the arms at their molded positions 60A, 62A, shown in greater detail in FIG. 11, are pivoted together about the living hinges 66, 68. As the arms are forced together to their use positions, their latches 70, 72 interlock, and the spacer arms are then permanently held together between the contacts. In practice, the plastic is still very warm when the arms are pivoted together which facilitates such pivoting although they could be pivoted together even after the plastic part cools.

Figure 9:
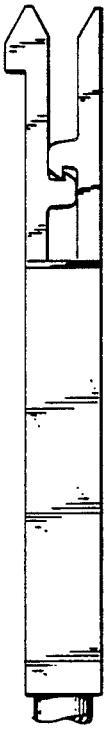
FIG. 9 is an elevation view of the support of the contact assembly of FIG. 8, with the arms pivoted together.
Figure 10:
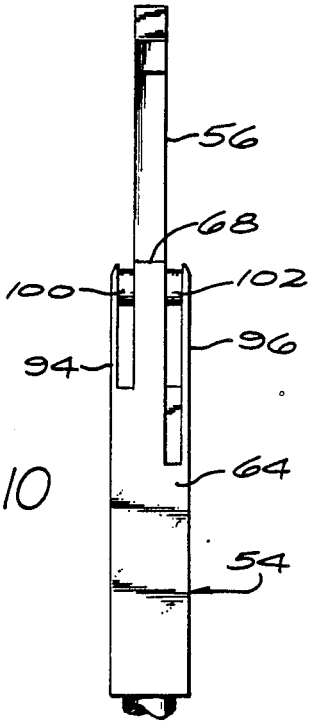
FIG. 10 is a side elevation view of FIG. 9.

It can be seen in FIGS. 9 and 10, that the rearward portion 64 of the support includes thin opposite face portions 94, 96 lying beyond the contact locations and also includes sprue-like rod portions 100, 102 that extend through holes in the contacts.

After the contact assembly has been formed, it is installed in the connector frame in the manner shown in FIG. 13. As the front of the contact assembly 16 is pressed into a passage 14, a beveled surface 104 on spacer arm 60 is deflected towards the other spacer arm 62. The forward portion of arm 60 (forward of latch 72) is free to bend to allow a projection or retainer 106 on arm 60 to pass along the passage 14. When the contact assembly has been fully installed, the retainer 106 snaps behind a forwardly-facing shoulder 110 formed at the rear of a recess 112 at the front of the connector. The contact assembly is then securely held. A plug contact 36 can be inserted through one of the holes 22 in the frame to spread apart the bite locations 34 on the arms 29, 30 of a contact 26. If a contact assembly must be removed, this is accomplished by inserting a removal tool 114 into the recess 112 to deflect the retainer 106 so the contact assembly can be pulled out by pulling rearwardly on the wire 20 thereof at the same time.

Figure 5:
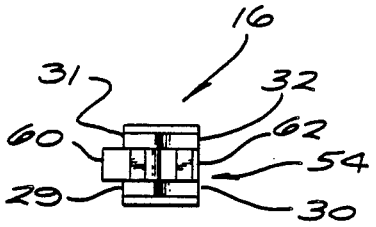
FIG. 5 is a plan view of the contact assembly of FIG. 3.

FIG. 12 shows the arrangement of the holes 22 and recess 112 that lie at the front end of each passage 14 in the connector frame 12. It can be seen that the passages 14 are of square cross section. The contact assembly 16 is also of square cross section (as shown in FIG. 5). While the contact assembly can be installed in any of four different orientations, only one of them will allow the projecting retainer to snap into place. Personnel will generally install the contact assemblies in the correct orientations, but after installation this can be checked by a moderate rearward pull on the wires, dislodging all but properly installed contact assemblies.

The construction of the contact assembly provides many advantages. The provision of the retainer 106 on the plastic spacer removes the retaining features from the electrical contacts. The plastic support locates each sheet metal contact so the inner face such as **26*i* (FIG. 4) of the contact lies closely against the support 56 and the outer face 26*f* of the contact lies only a small distance from a wall of the passage in the connector frame. The plastic spacer portion lies at the height of the bites 34 of the contacts to support them as they mate with the plug contacts. The dielectric support is a unitary member that separates all portions of the spaced contacts, so the spacing between the contacts is closely predictable. The two conductors 50, 52 are generally a twisted wire pair, with one of them 50 being at ground potential and the other 52** carrying a signal, and it is desirable to maintain a closely predictable degree of electromagnetic coupling between them. The molding of the support to the pair of contacts helps achieve this.

There is a distinct advantage in allowing the retainer 104 to be released from the front of the connector frame (by tool 114, FIG. 13). Generally, there is a very dense thicket or mat of wires at the rear of the frame, as compared to the orderly arrangement of holes at the front of the frame. Applicant can insert the removal tool into the hole of the appropriate contact assembly, and then pull rearwardly on the wire which is believed to correspond to it. If the wire and contact assembly do not pull out, then applicant immediately notes that he has pulled on the wrong wire. The inclusion of a rectangular recess 112 in addition to the holes 22 at the front frame, allows identification of which of the holes (22Y) is for the grounded contact and which (22X) is for the signal contact. The fact that the recess 112 extends by much less than half the front-to-rear thickness of the connector, results in walls of greater thickness B in the frame, which strengthens the frame and allows for closer spacing of the passages.

The contacts are mounted with their tails or rearward end portions 46, 48 (FIG. 2) offset from one another. This helps to keep the wire conductors 50, 52 further separated.

FIG. 15 shows some details of the plug connector 4. The plug contacts such as 36, 38 are mounted on a slider 120 which can be moved rearwardly by a cam to project the plug contacts into the holes in the socket connector.

Figure 3:
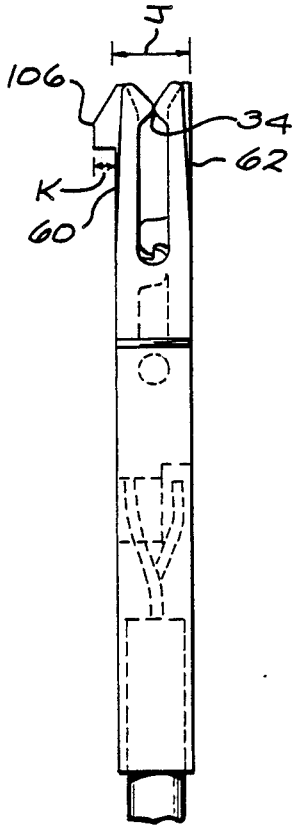
FIG. 3 is an elevation view of the contact assembly of FIG. 2.
Figure 7:
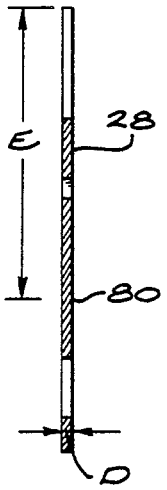
FIG. 7 is a view taken on the line 7—7 of FIG. 6.

Applicant has constructed a connector of the type illustrated in FIGS. 1–14. The contacts such as 28 (FIGS. 6 and 7) have a width C of 50 mil (one mil equals one thousandth of an inch), a thickness D of 10 mil, and a height E of 296 mil. The support 54 (FIG. 4) has a height F of 401 mil, and an overall thickness G of 50 mil. The spacer portion 56 has a thickness H of 20 mil, which equals the separation of the contacts. The support has a width J (FIG. 3) of 50 mil except at the projecting retainer 106 which projects sidewardly by a distance K of 13 mil.

FIG. 16 illustrates a contact assembly 130 which includes four dual-arm socket contacts 131–134 lying in four parallel planes and spaced apart by three spacer portions 140–142 of a dielectric support 144. Each of the spacer portions 140–142 is substantially the same as the spacer portions of the contact assembly of FIG. 2. The four contacts connect to the four conductors of wires 150, 152.

FIG. 17 is a plan view of another contact assembly 160 which includes eight dual-arm socket contacts 161–168 arranged in pairs. Each pair such as the contacts 161 and 162 are spaced apart by a spacer portion 170 of a dielectric support 172. The spacer portion 170 has two wide arms 174, 176 that are connected by living hinges to a rearward portion molded around the rearward portions of the contacts in a manner similar to that for the contact assemblies of FIGS. 1–14.

Thus, the invention provides a connector with multiple contact assemblies that each includes at least one pair of sheet metal contacts lying in spaced parallel planes and a dielectric support with a spacer portion between the parallel contacts. The support has a rearward portion molded tightly to the rearward portions of the contacts. However, the spacer portion is free of bonding to the front ends of the contacts. The spacer portion can include a pair of arms joined by living hinges to the rearward portion of the support, with the arms initially molded so they spread apart but are pivotable to positions between the contacts and latchable to each other thereat. The front end of one of the spacer arms forms a plain arm or retainer arm. That retainer arm can bend during insertion into a connector frame passage, and then unbends as the retainer snaps into a recess to hold the contact assembly in place. The contact assembly is especially useful for dual-arm socket contact, although much of the approach can be used for plug contacts.

Although particular embodiments of the invention have been described and illustrated herein, it is recognized that modifications and variations may readily occur to those skilled in the art and consequently it is intended to cover such modifications and equivalents.

What is claimed is:

1. In a connector which has a plurality of contacts, the improvement comprising:

first and second dual-arm socket contacts, each having a forward mating end portion with a pair of arms for receiving between them a plug contact moving along a mating path, and a rearward end portion, said socket contacts lying primarily in a pair of spaced parallel planes;

a dielectric support having a spacer portion of about the same thickness as the space between the forward portions of said contacts, said spacer portion lying between said contacts;

said dielectric support having a rearward portion molded tightly to said contact rearward end portions, but said arms of said contact forward end portions being free to deflect apart and together independently of said spacer portions.

2. The improvement described in claim 1 including:

a wire which includes a pair of conductors and an insulator separating and surrounding said conductors, said wire having an end portion which includes said insulation;

each of said conductors being connected to the rearward end portion of a different one of said socket contacts, and said support being molded tightly around said wire end portion including said insulation thereof.

3. The improvement described in claim 1 wherein:

said spacer portion of said dielectric support includes a pair of spacer arms that have rearward ends and said support includes a pair of hinge portions integral with and hingedly joining said rearward ends of said spacer arms to said rearward portion of said support, said spacer arms being pivotal between a molded position wherein they diverge and lie primarily on opposite sides of the space between said socket contacts, and a use position wherein they lie between said socket contacts.

4. The improvement described in claim 3 wherein:

said arms form latches which hold them together when they are moved to said use position.

5. The improvement described in claim 1 wherein:

said rearward portions of said socket contacts have through holes, and said rearward portion of said dielectric support includes face portions lying against the outside faces of said contacts and rod portions that extend from said face portions through said contact holes.

6. The improvement described in claim 1 wherein:

said support includes a pair of spacer arms that form said spacer portion, a first of said spacer arms having a retainer projecting sidewardly to a position beyond the space between said contacts;

said connector having a frame with a plurality of walls forming passages having forward end portions, said walls forming a recess at the forward end portion of each passage for receiving said retainer, each recess having a forwardly-facing shoulder against which said retainer can lie;

said spacer arms being spaced apart at the location of said retainer, the width of said spacer at said retainer being greater than the width of said passages, and said first arm being bendable toward the other arm to allow said contact assembly with said retainer to pass along said passage.

7. A connector comprising:

a frame which includes walls forming a plurality of passages with front and rear ends;

a plurality of contact assemblies insertable in said passages, each contact assembly including at least two sheet metal contacts lying in parallel planes, each contact having forward and rearward portions;

a molded dielectric support which includes a rearward portion molded to said rearward contact portions, a pair of spacer arms, and a pair of hinges each integral with said rearward support portion and one of said spacer arms, said spacer arms being pivotable between a first position wherein they diverge and a second position wherein they lie primarily parallel and between said forward contact portions;

each of said arms having a thickness about the same as the spacing between said pair of contacts, and said arms forming a latch device which holds said arms together between said contacts in said second position.

8. The connector described in claim 7 wherein:

a first of said spacer arms has a front end forming a sidewardly projecting retainer, said retainer lying forward of said latch device so a front portion of said first spacer arm can bend sidewardly to allow said contact assembly to enter and pass along one of said passages;

each of said passages has a rear end into which said contact assembly can be inserted, and has a width less than the width of said contact assembly with said retainer when said first arm is unbent but great enough to pass said contact assembly when said first spacer arm bends, each of said passages also having a front end with a recess in one of said walls extending sidewardly from the passage to receive said retainer.

9. A method for forming a contact assembly comprising:

joining each of two conductors of a wire to the rear portion of each of a pair of sheet metal contacts that also have matable forward portions;

establishing said contacts in parallel planes in a mold, and molding plastic about said conductors and about at least part of said contact rear portions to form a rearward plastic support portion, said step of molding also including molding a pair of spacer arms of a thickness approximately equal to the space between said contact forward portions and which are joined by hinge portions to said rearward support portion, but with said spacer arms diverting so forward portions of said arms lie on opposite sides of the space between said contact forward portions;

after said step of molding, establishing said spacer arms so their forward portions lie between said contact forward portions, including pivoting said arms toward each other about said hinge portions.

10. The method described in claim 9 wherein:

said step of molding includes forming a first of said spacer arms so it has a forward end with a retainer that projects sidewardly from the space between said contact forward portions; and including inserting said contact assembly into the rear of a passage in a connector frame and moving said contact assembly forwardly therealong, wherein the passage has a width approximately equal to the width of said contact assembly in the absence of said retainer projection, and wherein the passage has a recess at its front end;

said step of inserting including bending said first arm so said retainer projection fits into said passage with the rest of said contact assembly, until said projection reaches said recess, and allowing said arms to unbend while said projection enters said recess.

11. The method described in claim 9 wherein:

said step of molding includes forming a latch on each of said spacer arms, and said step of pivoting includes interlocking said latches when said spacer arm forward portions lie between said contact forward portions.

12. A contact assembly comprising:

first and second dual-arm socket contacts, each having a forward mating end portion with a pair of arms for receiving between them a plug contact moving along a mating path, and a rearward end portion, said socket contacts lying generally in a pair of spaced parallel planes;

a dielectric support having a spacer portion of about the same thickness as the space between the forward portions of said contacts, said spacer portion lying between said contacts; and said dielectric support having a rearward portion molded tightly to said contact rearward end portions, but said arms of said contact forward end portions being free to deflect apart and together independently of said spacer portion.

13. The improvement described in claim 12 wherein:

said spacer portion of said dielectric support includes a pair of spacer arms that have rearward ends and said support includes a pair of hinge portions integral with and hingedly joining said rearward ends of said spacer arms to said rearward portion of said support, said spacer arms being pivotal between a first position wherein they diverge and lie primarily on opposite sides of the space between said socket contacts, and a second position wherein they lie between said socket contacts.

14. The improvement described in claim 13 wherein:

said arms form latches which hold them together when they are moved to said second position.

15. The improvement described in claim 12 wherein:

said rearward portions of said socket contacts have through holes, and said rearward portion of said dielectric support includes face portions lying against the outside faces of said contacts and rod portions that extend from said face portions through said contacts holes.

* * * * *